US010801670B2

(12) United States Patent
Posselt et al.

(10) Patent No.: US 10,801,670 B2
(45) Date of Patent: Oct. 13, 2020

(54) TRANSPORT CONTAINER

(71) Applicant: Linde Aktiengesellschaft, Munich (DE)

(72) Inventors: Heinz Posselt, Bad Aibling (DE); Marko Parkkonen, Ytterby (SE)

(73) Assignee: Linde Aktiengesellschaft, Munich (DE)

( * ) Notice: Subject to any disclaimer, the term of this patent is extended or adjusted under 35 U.S.C. 154(b) by 123 days.

(21) Appl. No.: 16/098,499

(22) PCT Filed: May 4, 2017

(86) PCT No.: PCT/EP2017/025109
§ 371 (c)(1),
(2) Date: Nov. 2, 2018

(87) PCT Pub. No.: WO2017/190848
PCT Pub. Date: Nov. 9, 2017

(65) Prior Publication Data

US 2019/0145579 A1 May 16, 2019

(30) Foreign Application Priority Data

May 4, 2016 (EP) ..... 16000998

(51) Int. Cl.
*F17C 3/10* (2006.01)
*F17C 1/12* (2006.01)
*F17C 13/00* (2006.01)

(52) U.S. Cl.
CPC ..... *F17C 3/10* (2013.01); *F17C 1/12* (2013.01); *F17C 13/001* (2013.01); (Continued)

(58) Field of Classification Search
CPC ..... F17C 2221/017; F17C 2203/032; F17C 2223/0161; F17C 13/086; Y10S 220/901
See application file for complete search history.

(56) References Cited

U.S. PATENT DOCUMENTS 3,119,238 A * 1/1964 Chamberlain ..... F17C 3/08 62/51.1
3,416,693 A * 12/1968 Covington ..... F17C 3/08 220/560.13

(Continued)

FOREIGN PATENT DOCUMENTS

EP 1039211 A2 9/2000

OTHER PUBLICATIONS

International Search Report dated Jul. 25, 2017 issued in corresponding PCT/EP2017/025109 application (3 pages).
Multilayer Insulation XP-002762835—Wikipedia.de (Jan. 18, 2016).

*Primary Examiner* — Shawn M Braden
(74) *Attorney, Agent, or Firm* — Millen White Zelano & Branigan, PC; Brion P. Heaney

(57) ABSTRACT

The invention relates to a transport container (1) for helium (He), comprising an inner container (6) for receiving the liquid (He), an insulation element (26) that is provided on the exterior of the inner container (6), a coolant container (14) for receiving a cryogenic liquid ($N_2$), an outer container (2) in which the inner container (6) and the coolant container (14) are received, and a thermal shield (21) which can be actively cooled with the aid of the cryogenic liquid ($N_2$) and in which the inner container (6) is received, wherein a peripheral gap (31) is provided between the insulation element (26) and the thermal shield (21), and said insulation element (26) comprises a copper layer (27) that faces the thermal shield (21).

19 Claims, 2 Drawing Sheets

(52) U.S. Cl.
CPC ..... *F17C 2201/0109* (2013.01); *F17C 2201/0166* (2013.01); *F17C 2201/035* (2013.01); *F17C 2201/054* (2013.01); *F17C 2203/032* (2013.01); *F17C 2203/035* (2013.01); *F17C 2203/0308* (2013.01); *F17C 2203/0312* (2013.01); *F17C 2203/0316* (2013.01); *F17C 2203/0345* (2013.01); *F17C 2203/0366* (2013.01); *F17C 2203/0387* (2013.01); *F17C 2203/0391* (2013.01); *F17C 2203/0629* (2013.01); *F17C 2203/0643* (2013.01); *F17C 2221/014* (2013.01); *F17C 2221/017* (2013.01); *F17C 2223/0161* (2013.01); *F17C 2223/033* (2013.01); *F17C 2227/0381* (2013.01); *F17C 2260/033* (2013.01); *F17C 2270/01* (2013.01)

(56) References Cited

U.S. PATENT DOCUMENTS 3,782,128 A * 1/1974 Hampton ..... F17C 3/08 62/45.1
4,291,541 A * 9/1981 Kneip, Jr. ..... F17C 3/085 220/901
4,718,239 A * 1/1988 Nowobilski ..... F17C 3/10 62/50.4
6,521,077 B1 * 2/2003 McGivern ..... F16L 59/08 156/304.1

* cited by examiner

TRANSPORT CONTAINER

The invention relates to a transport container for helium.

Helium is extracted together with natural gas. For economic reasons, transport of large amounts of helium is expedient only in a liquid or supercritical form, that is to say at a temperature of approximately 4.2 to 6 K and under a pressure of 1 to 6 bar. For transporting the liquid or supercritical helium, use is made of transport containers which, to avoid the pressure of the helium increasing too rapidly, are provided with sophisticated thermal insulation. Such transport containers may be cooled for example with the aid of liquid nitrogen. This involves providing a thermal shield cooled with the liquid nitrogen. The thermal shield shields an inner container of the transport container. The liquid or cryogenic helium is received in the inner container. The holding time for the liquid or cryogenic helium in the case of such transport containers is 35 to 40 days, that is to say, after this time, the pressure in the inner container has increased to the maximum value of 6 bar. The supply of liquid nitrogen is sufficient for approximately 35 days. The thermal insulation of the transport container consists of high-vacuum multilayered insulation.

EP 1 673 745 B1 describes such a transport container for liquid helium. The transport container comprises an inner container, in which the liquid helium is received, a thermal shield, which partially covers the inner container, a coolant container, in which a cryogenic liquid for cooling the thermal shield is received, and an outer container, in which the inner container, the thermal shield and the coolant container are arranged.

Against this background, the object of the present invention is to provide an improved transport container.

Accordingly, a transport container for helium is proposed. The transport container comprises an inner container for receiving the helium, an insulation element, which is provided on the exterior of the inner container, a coolant container for receiving a cryogenic liquid, an outer container, in which the inner container and the coolant container are received, and a thermal shield, which can be actively cooled with the aid of the cryogenic liquid and in which the inner container is received, wherein a peripheral gap is provided between the insulation element and the thermal shield, and wherein the insulation element comprises a copper layer facing the thermal shield.

The inner container may also be referred to as a helium container or inner tank. The transport container may also be referred to as a helium transport container. The helium may be referred to as liquid or cryogenic helium. The helium is in particular likewise a cryogenic liquid. The transport container is in particular set up to transport the helium in a cryogenic or liquid form or in a supercritical form. In thermodynamics, the critical point is a thermodynamic state of a substance that is characterized by the densities of the liquid phase and the gas phase becoming identical. At this point, the differences between the two states of aggregation cease to exist. In a phase diagram, the point is the upper end of the vapor pressure curve. The helium is introduced into the inner container in a liquid or cryogenic form. A liquid zone with liquid helium and a gas zone with gaseous helium then form in the inner container. Therefore, after being introduced into the inner container, the helium has two phases with different states of aggregation, namely liquid and gaseous. That is to say, there is a phase boundary between the liquid helium and the gaseous helium in the inner container. After a certain time, that is to say when the pressure in the inner container increases, the helium situated in the inner container becomes single-phase. The phase boundary then no longer exists and the helium is supercritical.

The cryogenic liquid or the cryogen is preferably liquid nitrogen. The cryogenic liquid may alternatively also be for example liquid hydrogen or liquid oxygen. The statement that the thermal shield is actively coolable or actively cooled should be understood as meaning that the thermal shield is at least partially flowed through or flowed around by the cryogenic liquid in order to cool it. In particular, the thermal shield is actively cooled only in an operating state, that is to say when the inner container is filled with helium. When the cryogenic liquid has been used up, the thermal shield may also be uncooled. During the active cooling of the thermal shield, the cryogenic liquid can boil and evaporate. As a result, the thermal shield is at a temperature which corresponds approximately or exactly to the boiling point of the cryogenic liquid. The boiling point of the cryogenic liquid is preferably higher than the boiling point of the liquid helium. The thermal shield is in particular arranged inside the outer container.

Preferably, the inner container and in particular the insulation element are, on the outside, at a temperature which corresponds approximately or exactly to the temperature of the helium. The thermal shield may comprise a tubular base portion and a cover portion, which closes off the base portion at the end face and is arranged between the inner container and the coolant container. Preferably, the cover portion in this case completely closes off the base portion at the end face. The base portion of the thermal shield may have a circular or approximately circular cross section. The outer container, the inner container, the coolant container and the thermal shield may be constructed rotationally symmetrically in relation to a common axis of symmetry or center axis. The inner container and the outer container are preferably produced from high-grade steel. The inner container preferably has a tubular base portion, which is closed on both sides by curved cover portions. The inner container is fluid-tight. The outer container preferably likewise has a tubular base portion, which is closed at each of the two end faces by cover portions. The base portion of the inner container and/or the base portion of the outer container may have a circular or approximately circular cross section.

Providing the peripheral gap between the insulation element and the thermal shield has the effect that the insulation element is not in mechanical contact with the thermal shield. As a result, heat can only be transferred from the surfaces of the inner container to the thermal shield by radiation and residual gas conduction. The fact that the thermal shield is provided also ensures that the inner container is only surrounded by surfaces that are at a temperature corresponding to the boiling point of the cryogenic liquid (boiling point of nitrogen at 1.3 bara: 79.5 K). As a result, there is only a small difference in temperature between the thermal shield (79.5 K) and the inner container (temperature of the helium at 1 bara to 6 bara: 4.2 to 6 K) in comparison with the surroundings of the outer container. This allows the holding time for the liquid helium to be lengthened significantly in comparison with known transport containers.

The transport container has in particular a holding time for helium of at least 45 days, and the supply of the cryogenic liquid is sufficient for at least 40 days. An intermediate space between the inner container and the outer container is preferably evacuated. In order in the event of a breakdown of the vacuum to be able to blow off the helium contained in the inner container via safety valves provided on it, the inner container is surrounded with the insulation element, which reduces the heat input even in the case when there is no vacuum. As a result, the insulation element has the function of an emergency insulation for the event of a breakdown of the vacuum.

The copper layer may be a copper film or an aluminum film with a vapor-deposited coating. The copper layer has a metallically bright surface. This means that the copper layer is not surface-coated or oxidized. Since the emissivity of the copper layer decreases with decreasing temperature, the heat transfer by radiation also decreases, with the result that the overall heat input to the inner container can be suppressed to below 6 W over the entire helium holding time.

The copper layer preferably has a thickness of at least 5 micrometers, particularly preferably of at least 10 micrometers, preferably of less than 20 micrometers, particularly preferably in the range from 10 to 20 micrometers. The copper layer preferably comprises a proportion by mass of copper of at least 95% copper, particularly preferably of 99% copper and more particularly preferably of at least 99.9% copper. The copper layer preferably has a surface free of impurities, such as for example greases or oils.

According to one embodiment, the peripheral gap has a gap width of 5 to 15 millimeters, preferably of 10 millimeters.

The statement that the gap is peripheral should be understood as meaning that the gap is taken completely around the inner container. In particular, the gap is also provided on the cover portions of the inner container.

According to a further embodiment, the peripheral gap is evacuated.

This ensures that heat can only be transferred from the inner container to the thermal shield by radiation and residual gas conduction.

According to a further embodiment, the insulation element comprises a multilayered insulating layer arranged between the inner container and the copper layer.

The insulating layer may be a so-called MLI (multilayer insulation). The copper layer is preferably an additional layer of a smooth film of high-purity bright copper, which is drawn tightly and without creases onto the LMI.

According to a further embodiment, the multilayered insulating layer comprises multiple alternately arranged layers of aluminum film and glass paper.

The layers of aluminum film serve in this case as a reflector and as mechanical fixing for the layers of glass paper that ensure the thermal damping in the event of a breakdown of the vacuum. The aluminum film may be perforated and/or embossed.

According to another embodiment, the layers of aluminum film and glass paper are applied to the inner container without any gaps.

Without any gaps should be understood as meaning that the layers of aluminum film lie flat against the layers of glass paper. When applying the multilayered insulating layer to the inner container, it must be ensured that the mechanical pressing of the layers of aluminum film and glass paper is as great as possible, to achieve the effect that all of the layers are as isothermal as possible. An isothermal change in state is a thermodynamic change in state in which the temperature remains unchanged.

According to a further embodiment, the copper layer is a copper film.

In particular, the copper layer is a film of high-purity bright copper, which is drawn tightly and without creases onto the multilayered insulating layer.

According to a further embodiment, the transport container also comprises a multilayered insulating layer arranged between the thermal shield and the outer container.

The insulating layer is preferably likewise an MLI. The insulating layer preferably completely fills an intermediate space provided between the thermal shield and the outer container, with the result that the insulating layer contacts both the thermal shield and the outer container.

According to a further embodiment, the multilayered insulating layer comprises multiple alternately arranged layers of aluminum film and glass silk, glass mesh fabric or glass paper.

The layers of glass paper, glass silk or glass mesh fabric serve in this case as spacers between the layers of aluminum film, which serve as a reflector. The aluminum film is preferably perforated and embossed. This allows the insulating layer arranged between the thermal shield and the outer container to be evacuated without any problem. An undesired mechanical-thermal contact between the aluminum film layers is also reduced. This contact could disturb the temperature gradient, established by radiation exchange, of the aluminum film layers.

According to a further embodiment, the layers of aluminum film and glass silk, glass mesh fabric or glass paper are applied to the thermal shield with gaps.

With gaps should be understood as meaning that evacuable intermediate spaces are respectively provided between the layers of aluminum film and the layers of glass silk, glass mesh fabric or glass paper. In contrast to the insulation element of the inner container, the layers of aluminum film and glass silk, glass mesh fabric or glass paper of the insulating layer are preferably introduced loosely into the intermediate space provided between the thermal shield and the outer container. "Loosely" means here that the layers of aluminum film and glass paper are not pressed, with the result that the embossing and perforation of the aluminum film allows the insulating layer, and consequently the intermediate space, to be evacuated without any problem.

According to a further embodiment, the outer container is evacuated.

This ensures very good thermal insulation, because heat transfer is only possible by radiation and residual gas conduction.

According to a further embodiment, the thermal shield completely encloses the inner container.

Preferably, the thermal shield is produced from an aluminum material. In particular, the thermal shield is produced from a high-purity aluminum material. This results in particularly good heat-transport and heat-reflection properties. The fact that the thermal shield completely encloses the inner container ensures that the inner container is completely surrounded by surfaces that are at a temperature corresponding to the boiling temperature of the cryogenic liquid.

According to a further embodiment, the thermal shield has a base portion and two cover portions, which close off the base portion at both end faces.

Preferably, the two cover portions are curved. In particular, the cover portions are provided on the base portion in such a way that they are curved away from the base portion. One of the cover portions is preferably arranged between the coolant container and the inner container. It is in this way ensured that, even when there is a falling liquid level in the coolant container, the inner container is only surrounded by surfaces that are at a temperature corresponding to the boiling temperature of the cryogenic liquid.

According to a further embodiment, the thermal shield is fluid-permeable.

That is to say, the thermal shield is liquid- and gas-permeable. For this purpose, the thermal shield may have for example apertures, perforations or bores. As a result of the fluid permeability, the intermediate space provided between the inner container and the thermal shield can be evacuated.

Further possible implementations of the transport container also comprise combinations not explicitly specified of features or embodiments described above or below with regard to the exemplary embodiments. A person skilled in the art will also add individual aspects as improvements or supplementations to the respective basic form of the transport container.

BRIEF DESCRIPTION OF THE DRAWINGS

Further advantageous configurations of the transport container form the subject matter of the dependent claims and of the exemplary embodiments of the transport container described below. The transport container will be explained in detail hereinafter on the basis of preferred embodiments with reference to the appended figures, in which:

In the figures, elements that are identical or have the same function have been provided with the same reference signs, unless stated otherwise.

Figure 1:
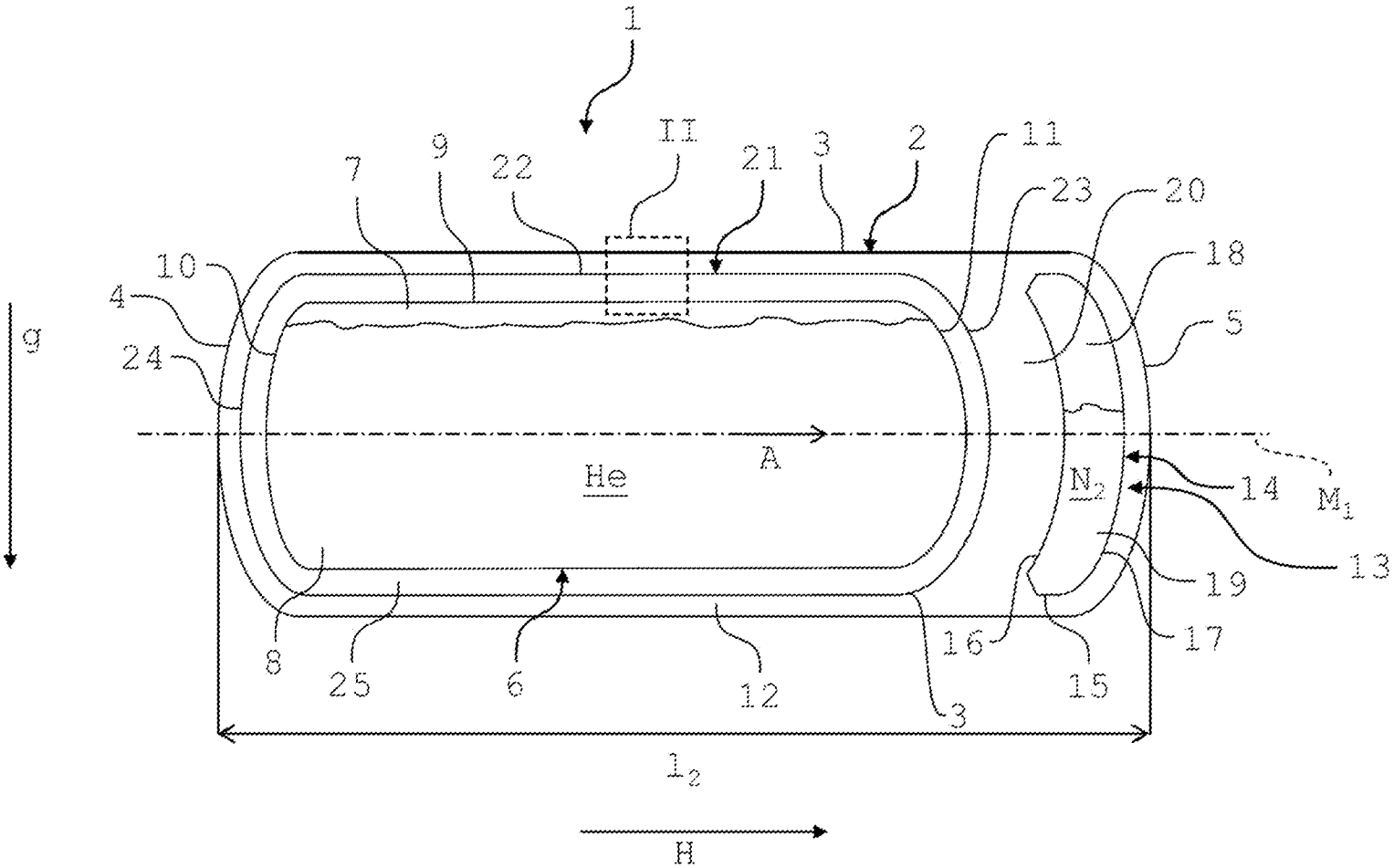
FIG. 1 shows a schematic sectional view of one embodiment of a transport container.
Figure 2:
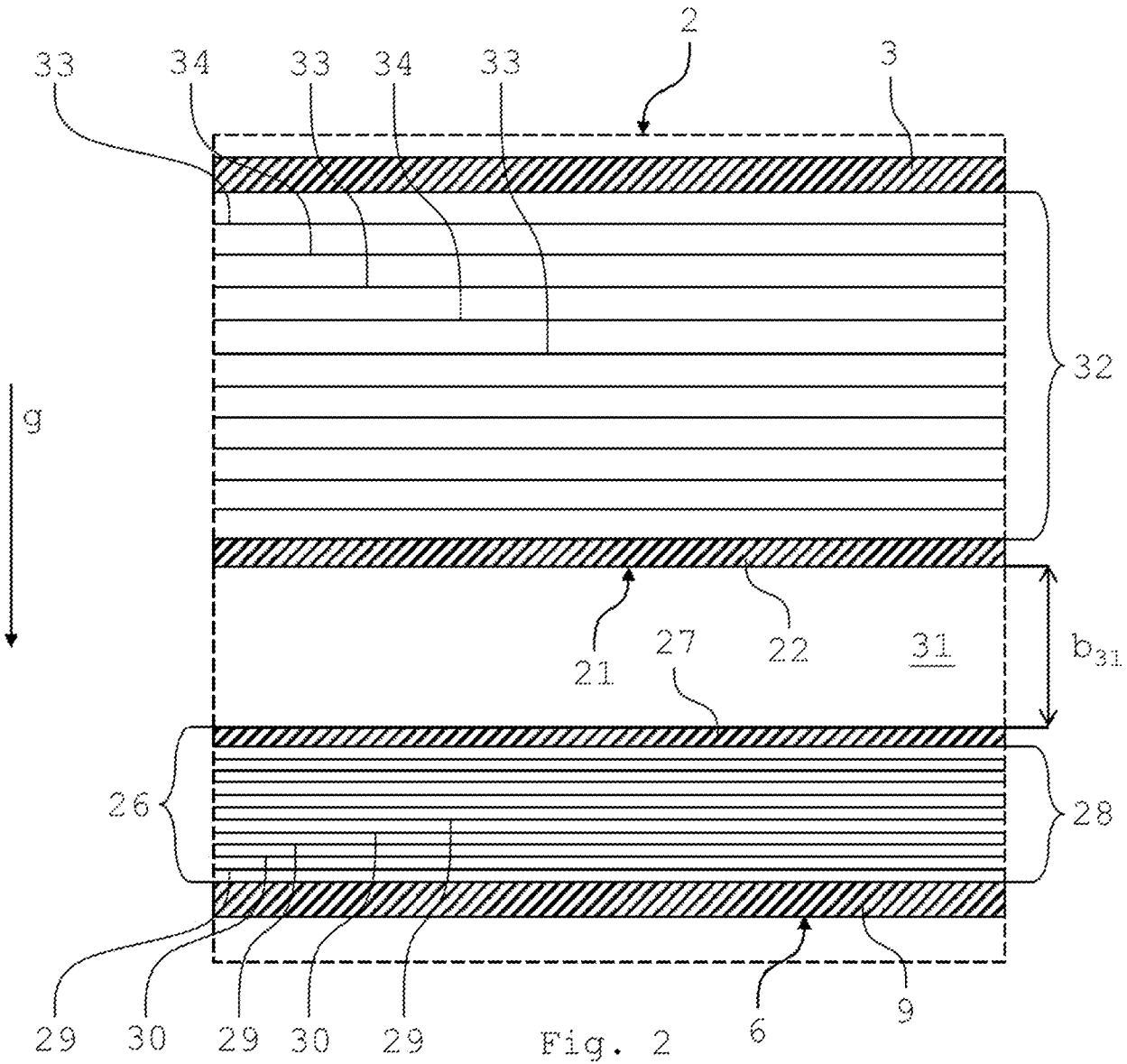
FIG. 2 shows the view of a detail II according to FIG. 1.

FIG. 1 shows a highly simplified schematic sectional view of one embodiment of a transport container 1 for liquid helium He. FIG. 2 shows the view of a detail II according to FIG. 1. In the following, reference is made to FIGS. 1 and 2 at the same time.

The transport container 1 may also be referred to as a helium transport container. The transport container 1 may also be used for other cryogenic liquids. Examples of cryogenic liquids, or cryogens for short, are the previously mentioned liquid helium He (boiling point at 1 bara: 4.222 K=−268.928° C.), liquid hydrogen $H_2$ (boiling point at 1 bara: 20.268 K=−252.882° C.), liquid nitrogen $N_2$ (boiling point at 1 bara: 77.35 K=−195.80° C.) or liquid oxygen $O_2$ (boiling point at 1 bara: 90.18 K=−182.97° C.).

The transport container 1 comprises an outer container 2. The outer container 2 is produced for example from high-grade steel. The outer container 2 may have a length $l_2$ of for example 10 m. The outer container 2 comprises a tubular or cylindrical base portion 3, which is closed at each of both the end faces with the aid of a cover portion 4, 5, in particular with the aid of a first cover portion 4 and a second cover portion 5. The base portion 3 may have a circular or approximately circular geometry in cross section. The cover portions 4, 5 are curved. The cover portions 4, 5 are curved in opposite directions such that both cover portions 4, 5 are outwardly curved with respect to the base portion 3. The outer container 2 is fluid-tight, in particular gas-tight. The outer container 2 has an axis of symmetry or center axis $M_1$, in relation to which the outer container 2 is constructed rotationally symmetrically.

The transport container 1 also comprises an inner container 6 for receiving the liquid helium He. The inner container 6 is likewise produced for example from high-grade steel. As long as the helium He is in the two-phase region, a gas zone 7 with evaporated helium He and a liquid zone 8 with liquid helium He may be provided in the inner container 6. The inner container 6 is fluid-tight, in particular gas-tight, and may comprise a blow-off valve for controlled pressure reduction. Like the outer container 2, the inner container 6 comprises a tubular or cylindrical base portion 9, which is closed at both end faces by cover portions 10, 11, in particular a first cover portion 10 and a second cover portion 11. The base portion 9 may have a circular or approximately circular geometry in cross section.

Like the outer container 2, the inner container 6 is formed rotationally symmetrically in relation to the center axis $M_1$. An intermediate space 12 provided between the inner container 6 and the outer container 2 is evacuated. The transport container 1 also comprises a cooling system 13 with a coolant container 14. A cryogenic liquid, such as for example liquid nitrogen $N_2$, is received in the coolant container 14. The coolant container 14 comprises a tubular or cylindrical base portion 15, which may be constructed rotationally symmetrically in relation to the center axis $M_1$. The base portion 15 may have a circular or approximately circular geometry in cross section. The base portion 15 is closed at each of the end faces by a cover portion 16, 17. The cover portions 16, 17 may be curved. In particular, the cover portions 16, 17 are curved in the same direction. The coolant container 14 may also have a different construction.

A gas zone 18 with evaporated nitrogen $N_2$ and a liquid zone 19 with liquid nitrogen $N_2$ may be provided in the coolant container 14. The coolant container 14 is arranged next to the inner container 6 in an axial direction A of the inner container 6. An intermediate space 20, which may be part of the intermediate space 12, is provided between the inner container 6, in particular the cover portion 11 of the inner container, and the coolant container 14, in particular the cover portion 16 of the coolant container 14. That is to say, the intermediate space 20 is likewise evacuated.

The transport container 1 also comprises a thermal shield 21 assigned to the cooling system 13. The thermal shield 21 is arranged in the evacuated intermediate space 12 provided between the inner container 6 and the outer container 2. The thermal shield 21 is actively coolable or actively cooled with the aid of the liquid nitrogen $N_2$. "Active cooling" should be understood in the present case as meaning that, for cooling the thermal shield 21, the liquid nitrogen $N_2$ is passed through, or passed along, said shield. Here, the thermal shield 21 is cooled down to a temperature which corresponds approximately to the boiling point of the nitrogen $N_2$.

The thermal shield 21 comprises a cylindrical or tubular base portion 22, which is closed on both sides by a cover portion 23, 24 closing it off at the end face. Both the base portion 22 and the cover portions 23, 24 are actively cooled with the aid of the nitrogen $N_2$. The base portion 22 may have a circular or approximately circular geometry in cross section. The thermal shield 21 is preferably likewise constructed rotationally symmetrically in relation to the center axis $M_1$.

A first cover portion 23 of the thermal shield 21 is arranged between the inner container 6, in particular the cover portion 11 of the inner container 6, and the coolant container 14, in particular the cover portion 16 of the coolant container 14. A second cover portion 24 of the thermal shield 21 faces away from the coolant container 14. The thermal shield 21 is in this case self-supporting. That is to say that the thermal shield 21 is not supported on either the inner container 6 or the outer container 2. For this purpose, the thermal shield 21 may be provided with a carrying ring, which is suspended from the outer container 2 by support rods, in particular tension rods. Also, the inner container 6 may be suspended from the carrying ring via further support rods. The heat input through the mechanical support rods is partially realized by the carrying ring. The carrying ring has pockets, which allow the support rods to be of the greatest possible thermal length. The coolant container 14 has bushings for the mechanical support rods.

The thermal shield 21 is fluid-permeable. That is to say that an intermediate space 25 between the inner container 6 and the thermal shield 21 is in fluid connection with the intermediate space 12. As a result, the intermediate spaces 12, 25 can be evacuated simultaneously. Bores, apertures or the like may be provided in the thermal shield 21, in order to allow evacuation of the intermediate spaces 12, 25. The thermal shield 21 is preferably produced from a high-purity aluminum material.

The first cover portion 23 of the thermal shield 21 shields the coolant container 14 completely from the inner container 6. That is to say, when looking in the direction from the inner container 6 toward the coolant container 14, the coolant container 14 is completely covered by the first cover portion 23 of the thermal shield 21. In particular, the thermal shield 21 completely encloses the inner container 6. That is to say, the inner container 6 is arranged completely inside the thermal shield 21, wherein, as already mentioned above, the thermal shield 21 is not fluid-tight.

The thermal shield 21 comprises at least one, but preferably multiple, cooling lines for actively cooling it. For example, the thermal shield 21 may have six cooling lines. The cooling line(s) is/are in fluid connection with the coolant container 14 such that the liquid nitrogen $N_2$ can flow into the cooling line(s) from the coolant container 14. The cooling system 13 may also comprise a phase separator (not shown in FIG. 1), which is set up to separate gaseous nitrogen $N_2$ from liquid nitrogen $N_2$. It is possible via the phase separator for the gaseous nitrogen $N_2$ to be blown off from the cooling system 13.

The cooling line(s) is/are provided both on the base portion 22 and on the cover portions 23, 24 of the thermal shield 21. The cooling line or the cooling lines has/have a gradient with respect to a horizontal H, which is arranged perpendicular to a direction of gravitational force g. In particular, the cooling line or the cooling lines includes/include an angle of greater than 3° with the horizontal H.

The inner container 6 also comprises an insulation element 26 that is shown as a detail in FIG. 2. The insulation element 26 completely encloses the inner container 6. That is to say that the insulation element 26 is provided both on the base portion 9 and on the cover portions 10, 11 of the inner container 6. The insulation element 26 is provided between the inner container 6 and the thermal shield 21. That is to say that the insulation element 26 is arranged in the intermediate space 25. The insulation element 26 has a highly reflective copper layer 27 on the outer side, that is to say facing the thermal shield 21. The copper layer 27 is metallically bright. That is to say that the copper layer 27 does not have a surface coating or oxide layer. The copper layer 27 may be for example a copper film or an aluminum film with a vapor-deposited copper coating.

The actual thermal damping of the inner container 6 with respect to the temperature level of the liquid nitrogen $N_2$ of the thermal shield 21 is provided by the copper layer 27. Preferably, the copper layer 27 is a smooth film of high-purity bright copper, which is drawn tightly and without creases around a multilayer insulating layer 28 arranged between the copper layer 27 and the inner container 6. The insulating layer 28 comprises multiple alternately arranged layers of perforated and embossed aluminum film 29, as a reflector, and glass paper 30, as a spacer and as damping in the event of a breakdown of the vacuum, between the aluminum films 29. The insulating layer 28 may comprise 10 layers. The layers of aluminum film 29 and glass paper 30 are applied on the inner container 6 without any gaps, that is to say are pressed. The insulating layer 28 may be what is known as an MLI. The inner container 6 and also the insulation element 26 are, on the outside, approximately at a temperature corresponding to the boiling point of the helium He. During the mounting of the insulating layer 28, it is ensured that the layers of aluminum film 29 and glass paper 30 have the greatest possible mechanical pressing, to achieve the effect that all of the layers of the insulating layer 28 are as isothermal as possible.

Provided between the insulation element 26 and the thermal shield 21 is a gap 31, running completely around the inner container 6. The gap 31 is also provided between the insulation element 26 and the cover portions 23, 24 of the thermal shield 21. The gap 31 has a gap width $b_{31}$. The gap width $b_{31}$ is preferably 5 to 15 mm, but preferably 10 mm. The gap 31 is evacuated. In particular, the gap 31 is part of the intermediate space 25. The intermediate space 25 is in this case filled by the insulation element 26 apart from the gap 31.

A further multilayered insulating layer 32, in particular likewise an MLI, may be arranged between the thermal shield 21 and the outer container 2, which insulating layer completely fills the intermediate space 12 and thus makes contact with the outside of the thermal shield 21 and the inside of the outer container 2. The insulating layer 32 is provided both between the respective base portions 3, 22 and between the cover portion 24 of the thermal shield 21 and the cover portion 4 of the outer container 2 and also between the cover portion 23 of the thermal shield 21 and the coolant container 14. The insulating layer 32 likewise comprises alternately arranged layers of aluminum film 33 and glass silk, glass mesh fabric or glass paper 34, which however, in contrast to the previously described insulation element 26 of the inner container 6, are in this case introduced loosely into the intermediate space 12. "Loosely" means here that the layers of aluminum film 33 and glass paper 34 are not pressed, with the result that the embossing and perforation of the aluminum film 33 allows the insulating layer 32, and consequently the intermediate space 12, to be evacuated without any control.

With the aid of the gap 31, the thermal shield 21 is arranged peripherally spaced apart from the copper layer 27 of the insulation element 26 of the inner container 6 and is not in contact with it. As a result, the heat input by radiation is reduced to the minimum physically possible. Heat is only transferred from the surfaces of the inner container 6 to the thermal shield 21 by radiation and residual gas conduction.

The functioning mode of the transport container 1 will be explained below. Before the filling of the inner container 6 with the liquid helium He, firstly the thermal shield 21 is cooled down with the aid of cryogenic, initially gaseous and later liquid, nitrogen $N_2$ at least approximately or right up to the boiling point (at 1.3 bara: 79.5 K) of the liquid nitrogen $N_2$. The inner container 6 is in this case not yet actively cooled. During the cooling down of the thermal shield 21, the residual vacuum gas still situated in the intermediate space 12 is frozen out on the thermal shield 21. In this way, when filling the inner container 6 with the liquid helium He, it can be prevented that the residual vacuum gas is frozen out on the outside of the inner container 6 and thereby contaminates the metallically bright surface of the copper layer 27 of the insulation element 26 of the inner container 6. As soon as the thermal shield 21 and the storage container 14 have cooled down completely and the coolant container 14 is again filled, the inner container 6 is filled with the liquid helium He.

The transport container 1 may then be transferred onto a transporting vehicle, such as for example a truck or a ship, for the purpose of transporting the liquid helium He. This involves cooling the thermal shield 21 continuously with the aid of the liquid nitrogen $N_2$. The liquid nitrogen $N_2$ is thus used and boils in the cooling lines of the cooling system 13. Gas bubbles produced in the process are fed through the phase separator that is arranged highest in the cooling system 13 with respect to the direction of gravitational force g. With the aid of the phase separator, the gaseous nitrogen $N_2$ situated in the cooling system 13 can be blown off, whereby the liquid nitrogen $N_2$ from the coolant container 14 can flow in after it.

Since the copper layer 27 does not have any mechanical contact with the thermal shield 21 because of the gap 31, heat can only be transferred from the surfaces of the inner container 6 to the thermal shield 21 by radiation and residual gas conduction. Since the copper layer has been drawn tightly onto the insulating layer 28, it has good mechanical contact with the insulating layer 28, and the copper layer 27 is likewise at a temperature that is close to the temperature of the helium He. Since the degree of emission or the emissivity of the copper layer 27 decreases with decreasing temperature, the heat transfer by radiation also decreases, with the result that the overall heat input to the inner container 6 can be suppressed to below 6 W over the holding time for the helium He. The degree of emission of a body indicates how much radiation it gives off in comparison with an ideal heat emitter, a black body.

The fact that the inner container 6 is completely surrounded by the thermal shield 21 means that it is ensured that the inner container 6 is only surrounded by surfaces that are at a temperature corresponding to the boiling point (1.3 bara, 78.5 K) of nitrogen $N_2$. In this way, there is only a small difference in temperature between the thermal shield 21 (78.5 K) and the inner container (4.2-6 K). This allows the holding time for the liquid helium He to be lengthened significantly in comparison with known transport containers. The transport container 1 has in particular a holding time for helium of at least 45 days, and the supply of liquid nitrogen $N_2$ is sufficient for at least 40 days. The insulation element 26 has the function of an emergency insulation for the inner container 6 for the event of a breakdown of the vacuum.

Although the present invention has been described using exemplary embodiments, it is modifiable in various ways.

REFERENCE SIGNS USED

1 Transport container
2 Outer container
3 Base portion
4 Cover portion
5 Cover portion
6 Inner container
7 Gas zone
8 Liquid zone
9 Base portion
10 Cover portion
11 Cover portion
12 Intermediate space
13 Cooling system
14 Coolant container
15 Base portion
16 Cover portion
17 Cover portion
18 Gas zone
19 Liquid zone
20 Intermediate space
21 Shield
22 Base portion
23 Cover portion
24 Cover portion
25 Intermediate space
26 insulation element
27 Copper layer
28 Insulating layer
29 Aluminum film
30 Glass paper
31 Gap
32 Insulating layer
33 Aluminum film
34 Glass paper
A Axial direction
$b_{31}$ Gap width
g Direction of gravitational force
H Horizontal
He Helium
$H_2$ Hydrogen
$l_2$ Length
$M_1$ Central axis
$N_2$ Nitrogen
$O_2$ Oxygen

The invention claimed is:

1. A transport container for helium, comprising:
an inner container for receiving helium,
an insulation element, which is provided on the exterior of the inner container,
a coolant container for receiving a cryogenic liquid,
an outer container, in which the inner container and the coolant container are received,
a thermal shield, which can be actively cooled with the aid of the cryogenic liquid and in which the inner container is received, and
a multilayered insulating layer arranged between the thermal shield and the outer container,
wherein a peripheral gap is provided between the insulation element and the thermal shield, and wherein the insulation element comprises a copper layer facing the thermal shield.

2. The transport container as claimed in claim 1, wherein the peripheral gap (31) has a gap width ($b_{31}$) of 5 to 15 millimeters.

3. The transport container as claimed in claim 1, wherein the peripheral gap is evacuated.

4. The transport container as claimed in claim 1, wherein the insulation element comprises a multilayered insulating layer arranged between the inner container and the copper layer.

5. The transport container as claimed in claim 4, wherein the multilayered insulating layer arranged between the inner container and the copper layer comprises multiple alternately arranged layers of aluminum film and glass paper.

6. The transport container as claimed in claim 5, wherein the layers of aluminum film and glass paper are applied to the inner container without any gaps.

7. The transport container as claimed in claim 1, wherein the copper layer is a copper film.

8. The transport container as claimed in claim 1, wherein the multilayered insulating layer arranged between the thermal shield and the outer container comprises multiple alternately arranged layers of aluminum film and glass silk, glass mesh fabric or glass paper.

9. The transport container as claimed in claim 8, wherein the layers of aluminum film and glass silk, glass mesh fabric or glass paper are applied to the thermal shield with gaps.

10. The transport container as claimed in claim 1, wherein the outer container is evacuated.

11. The transport container as claimed in claim 1, wherein the thermal shield completely encloses the inner container.

12. The transport container as claimed in claim 1, wherein the thermal shield has a base portion and two cover portions, which close off the base portion at both end faces.

13. The transport container as claimed in claim 1, wherein the thermal shield is fluid-permeable.

14. A transport container for helium, comprising:

an inner container for receiving helium, an insulation element, which is provided on the exterior of the inner container, a coolant container for receiving a cryogenic liquid, an outer container, in which the inner container and the coolant container are received, and a thermal shield, which can be actively cooled with the aid of the cryogenic liquid and in which the inner container is received, wherein a peripheral gap is provided between the insulation element and the thermal shield, and wherein the insulation element comprises a copper layer facing the thermal shield, and wherein the thermal shield is fluid-permeable.

15. The transport container as claimed in claim 1, wherein the cryogenic liquid is liquid nitrogen, liquid hydrogen, or liquid oxygen.

16. The transport container as claimed in claim 1, wherein the copper layer has a thickness of at least 5 micrometers and less than 20 micrometers.

17. The transport container as claimed in claim 1, wherein the copper layer has a thickness in the range from 10 to 20 micrometers.

18. The transport container as claimed in claim 1, wherein the thermal shield is produced from an aluminum material.

19. The transport container as claimed in claim 1, wherein the outer container comprises a tubular or cylindrical base portion, which is closed at each end face by, respectively, a first cover portion and a second cover portion, the first and second cover portions are curved in opposite directions such that both cover portions are outwardly curved with respect to the base portion, the inner container comprises a tubular or cylindrical base portion, which is closed at each end face by, respectively, a first cover portion and a second cover portion, the first and second cover portions are curved in opposite directions such that both cover portions are outwardly curved with respect to the base portion, the coolant container comprises a tubular or cylindrical base portion, which is closed at each end face by, respectively, a first cover portion and a second cover portion, the first and second cover portions are curved in the same direction, and the thermal shield comprises a cylindrical or tubular base portion, which is closed at each end face by, respectively, a first cover portion and a second cover portion.

* * * * *